US008998751B2

(12) United States Patent
Ragen

(10) Patent No.: US 8,998,751 B2
(45) Date of Patent: Apr. 7, 2015

(54) PUNTING TRAINING DEVICE

(71) Applicant: Peter D. Ragen, Pewaukee, WI (US)

(72) Inventor: Peter D. Ragen, Pewaukee, WI (US)

( * ) Notice: Subject to any disclaimer, the term of this patent is extended or adjusted under 35 U.S.C. 154(b) by 142 days.

(21) Appl. No.: 13/662,857

(22) Filed: Oct. 29, 2012

(65) Prior Publication Data

US 2013/0109509 A1 May 2, 2013

Related U.S. Application Data

(60) Provisional application No. 61/553,607, filed on Oct. 31, 2011.

(51) Int. Cl.
*A63B 69/00* (2006.01)
*A63B 71/02* (2006.01)

(52) U.S. Cl.
CPC ..... *A63B 69/002* (2013.01); *A63B 69/0075* (2013.01); *A63B 2071/025* (2013.01); *A63B 2209/08* (2013.01); *A63B 2210/50* (2013.01); *A63B 2225/09* (2013.01); *A63B 2225/093* (2013.01)

(58) Field of Classification Search
CPC .. A63B 69/00; A63B 69/002; A63B 69/0075; A63B 69/345; A63B 2243/007; A63B 2243/0025; A63B 2243/0066
USPC ..... 473/422, 438, 419, 420, 417
See application file for complete search history.

(56) References Cited

U.S. PATENT DOCUMENTS

| | | | | | |
|---|---|---|---|---|---|
| 2,767,985 | A | * | 10/1956 | Maxcey, Jr. et al. | 473/438 |
| 3,087,726 | A | * | 4/1963 | Pogue | 473/420 |
| 3,399,892 | A | * | 9/1968 | Jurkiewicz | 473/438 |
| 3,439,916 | A | | 4/1969 | Kopp | |
| 3,462,145 | A | * | 8/1969 | Shirley et al. | 473/419 |
| 3,534,958 | A | * | 10/1970 | Lipscomb | 473/439 |
| 3,662,728 | A | * | 5/1972 | Retrum | 473/438 |
| 4,261,564 | A | | 4/1981 | Holahan et al. | |
| 4,561,661 | A | | 12/1985 | Walker et al. | |
| 4,906,001 | A | * | 3/1990 | Vaughn | 473/438 |
| 5,100,135 | A | * | 3/1992 | Bourgeois | 473/420 |
| 5,280,922 | A | | 1/1994 | Jones | |
| 5,553,855 | A | | 9/1996 | Balestrieri | |
| 5,613,678 | A | * | 3/1997 | McKee et al. | 473/420 |
| 6,050,906 | A | * | 4/2000 | Stout et al. | 473/438 |
| 6,475,108 | B1 | | 11/2002 | Sarenana, Sr. et al. | |
| 6,575,852 | B2 | * | 6/2003 | Orner | 473/438 |
| 6,718,961 | B1 | * | 4/2004 | Woods et al. | 473/438 |
| 7,806,787 | B1 | * | 10/2010 | Gamboa | 473/438 |

* cited by examiner

*Primary Examiner* — Mitra Aryanpour
(74) *Attorney, Agent, or Firm* — Michael Best & Friedrich LLP

(57) ABSTRACT

A training device adapted to support a ball above a support surface for punting. The training device includes a base assembly adapted to be disposed on the support surface, and a ball support assembly coupled to the base assembly and adapted to contact the bottom of the ball from at least one side of the ball such that the ball is supported above the support surface for punting when the ball support assembly is in a support position.

22 Claims, 13 Drawing Sheets

PUNTING TRAINING DEVICE

CROSS REFERENCE TO RELATED APPLICATIONS

This application claims priority to U.S. Provisional Patent Application No. 61/553,607, which was filed on Oct. 31, 2011, the entire contents of which are hereby incorporated by reference.

BACKGROUND

The present invention relates to a training device for punting footballs or soccer balls as well an exercise device for strengthening leg muscles.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
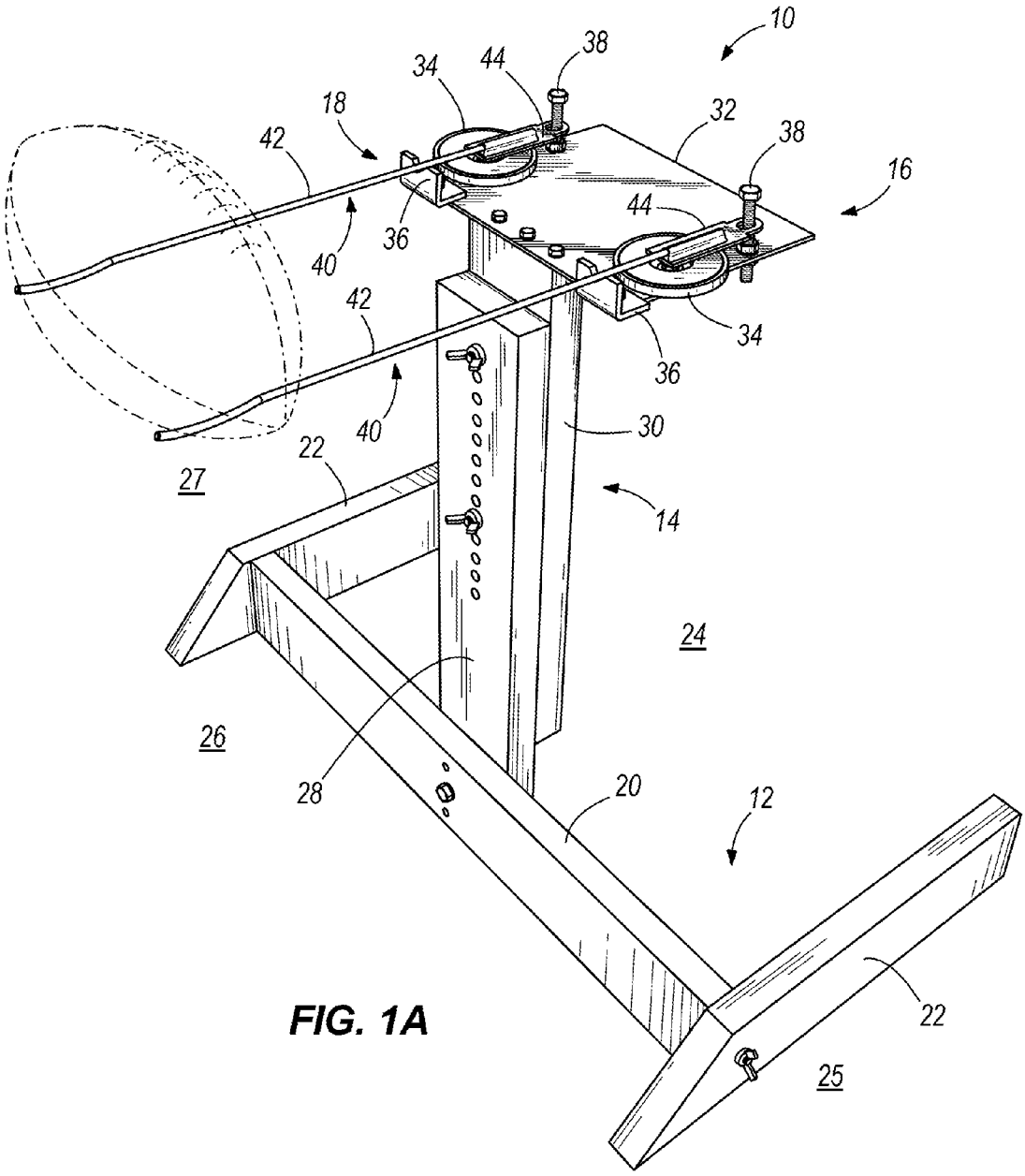
FIG. 1A is a front perspective view of one construction of a training device supporting a football.
Figure 1B:
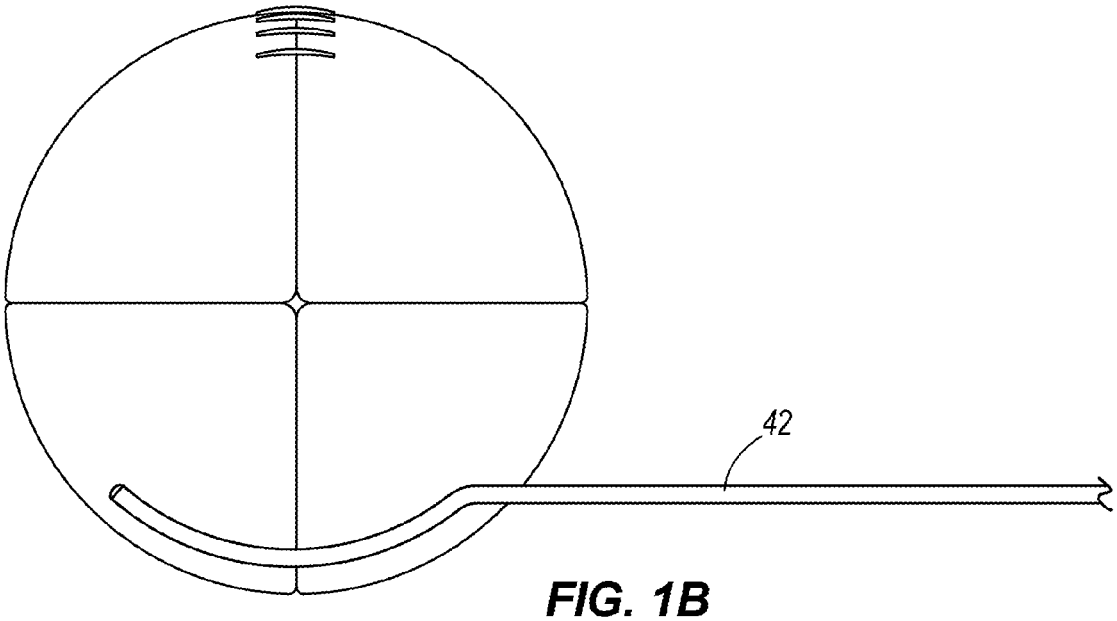
FIG. 1B is a front view of a portion of the training device of FIG. 1A.
Figure 2:
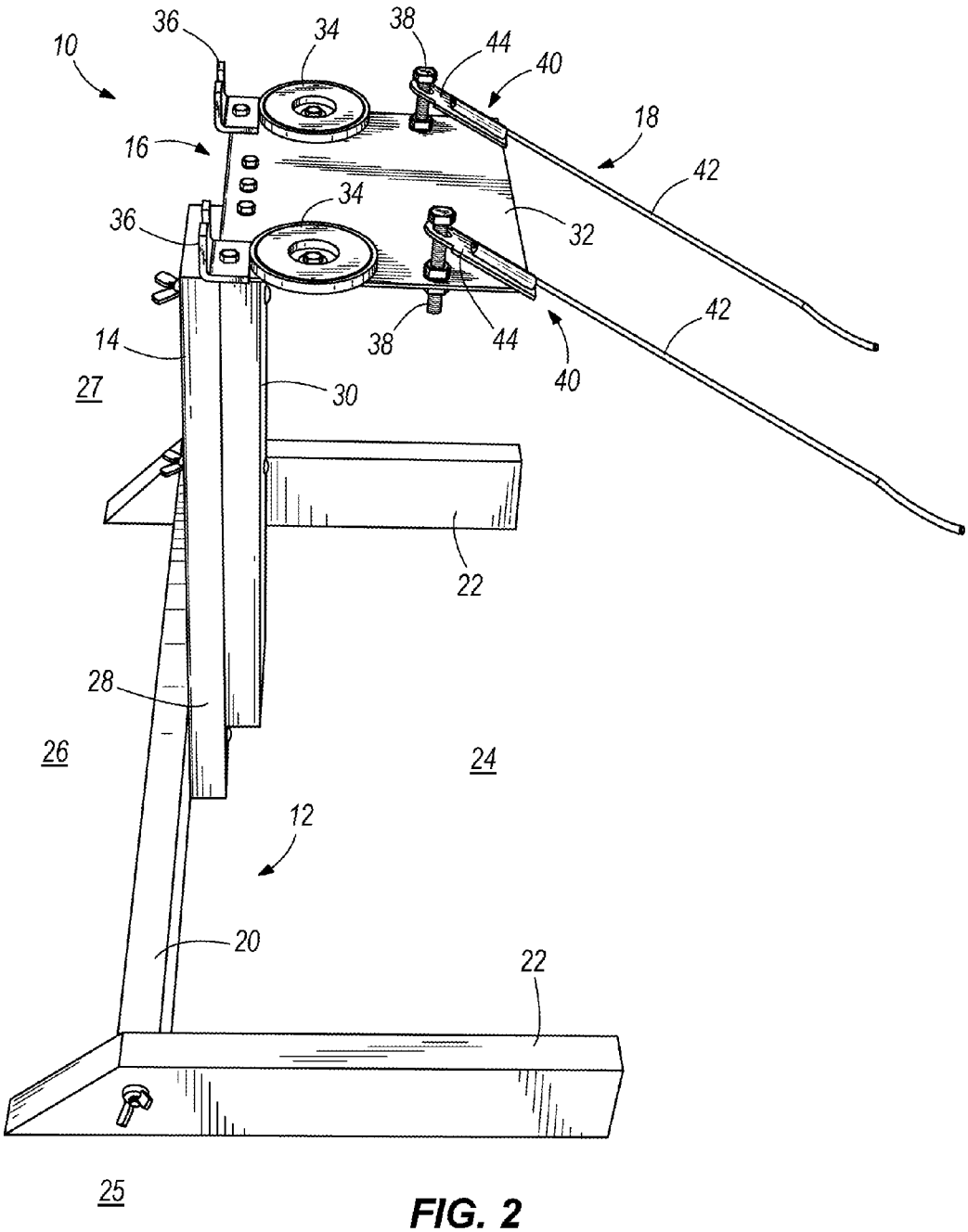
FIG. 2 is a front perspective view of the training device of FIG. 1A, illustrating a position of rod assemblies after the football has been kicked.
Figure 3:
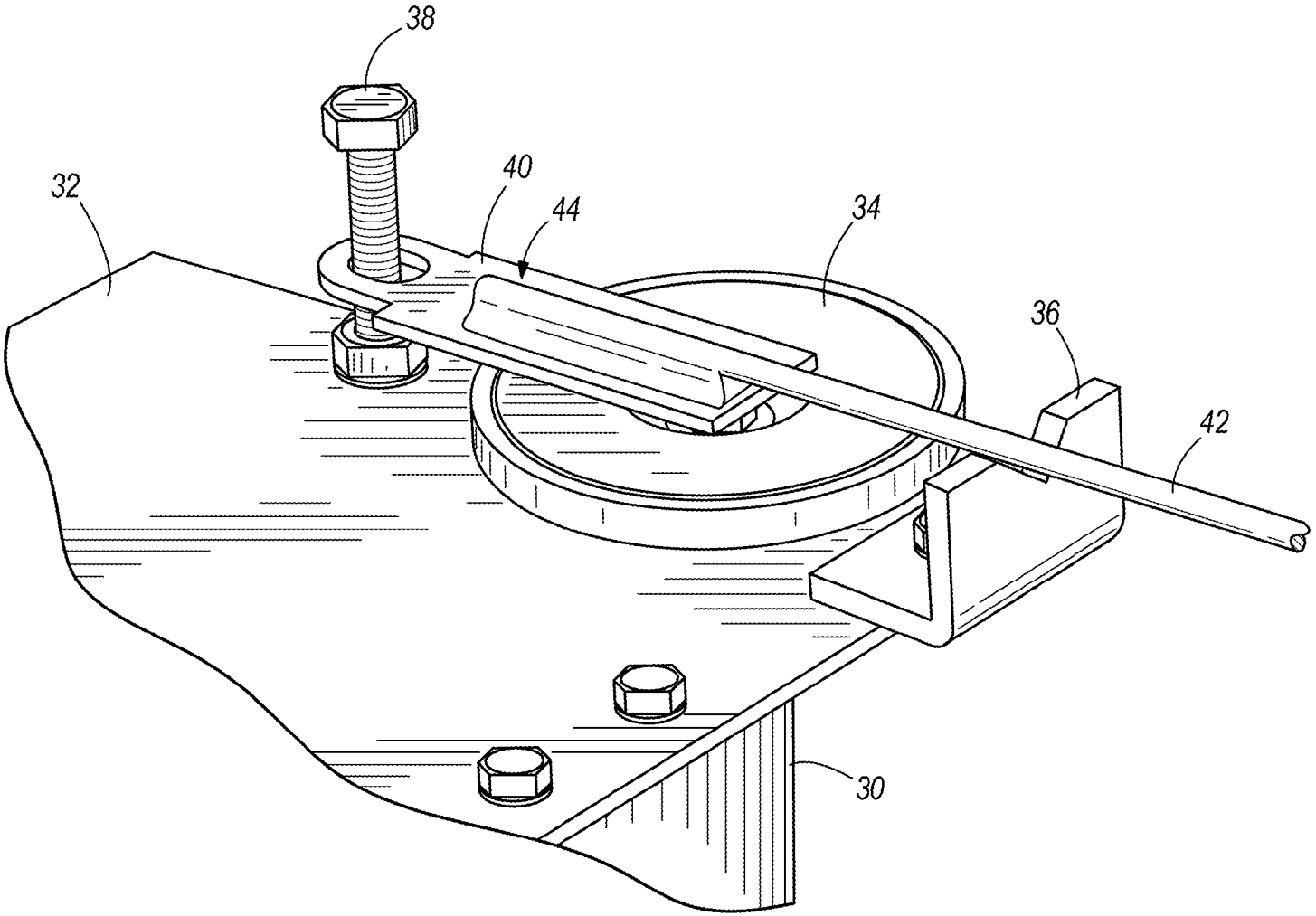
FIG. 3 is an enlarged perspective view of a portion of rod assembly of the training device of FIG. 1A.

FIGS. 1-3 illustrate a punting training device 10 according to one construction of the invention. The training device 10 is used to support a ball (e.g., a football, soccer ball, rugby ball, or playground ball) from one side in an appropriate, stationary position for a person to swing their leg and punt the ball away from the training device 10. The training device 10 is used to improve punting skills such as distance punting, directional punting, "pooch" punting (i.e., punting to a specific direction and distance). Likewise, the training device 10 can be used for exercising and strengthening one's leg muscles.

The training device is used for punting a football which involves many factors. The main factors are approaching the football before the punt, dropping the football, and punting the football. The training device eliminates dropping the football and holds the football at the proper height and position so as to allow the punter to train maximizing or minimizing the dynamics of a punt including height, distance, spiral, or tumbling action of the football. By use of this training device, the punter can concentrate his practice on the approach and the punt only.

As shown in FIG. 1, the training device 10 includes a base assembly 12, an adjustable upright assembly 14, a platform assembly 16, and a ball support assembly 18. The base assembly 12 is generally U-shaped and includes a center member 20 having two opposed ends, and two side members 22, each being connected at one end to an end of the center member 20 such that each side 22 member extends away from the center member 20 in a common direction (i.e., on a first side 24 of the center member 20). The base assembly 12 defines a bottom plane and is configured to be supported on a support surface such as the ground. In some constructions, the two side members 22 can be connected to the center member 20 with hinges, which allow the base assembly 12 to be folded into a more compact configuration making it easier to transport.

On the same side of the center member 20 in which the side members 12 extend (i.e., the first side), the upright assembly 14 is connected to the base 12 and extends vertically upward. In other constructions, the upright assembly 14 can be connected on the second side 26 or directly above the center member 20. As shown in FIG. 1, the training device 10 also includes a front 25 and a back 27. The upright assembly 14 includes a bottom upright 28 fastened to the center member 20 and an upper upright 30 that is adjustably fastened to the bottom upright 28. In the illustrated embodiment, the bottom and upper uprights 28, 30 include a series of holes that align with each other at different positions such that fasteners (e.g., bolts and wing nuts) can be used to connect the upper upright 30 to the bottom upright 28 in a desired vertical position. The platform assembly 16 is connected to the top of the upper upright 30. In other constructions, the base assembly 12 can be replaced with a stake (not shown) that can be driven into the ground. In this construction, the upright assembly 14 can be mounted to the top of the stake. In yet other constructions, the platform assembly 16, upright assembly 14, and stake could be integrated into a single piece. In other constructions, plastic tubing and elbow joints could be used to construct the base assembly 12 and telescoping plastic tubes could be used to construct the upright assembly 14.

The platform assembly 16 is connected to the top of the upper upright 30. The platform assembly 16 includes a platform 32 that is generally arranged in a horizontal orientation. In other embodiments, the platform 32 can pivot relative to the upright assembly 14 to adjust the angle relative to horizontal. For example, the platform 32 could pivot in the front-to-back direction, pivot in the side-to-side direction, or both. Such a construction is described in greater detail with respect to FIGS. 9A-9C below. The platform assembly 16 includes a front magnet 34 connected to the front of the platform 32 and a rear magnet 34 connected to the rear of the platform 32. The platform assembly 16 also includes a front bracket 36 connected to the front of the platform 32 and a rear bracket 36 connected to the rear of the platform 32. The top edge of each of the brackets 36 forms a V-shaped notch. The brackets 36 are paired with the magnets 34 and are positioned on the side of the platform 32 closest to the second side 26 of the training device, which is opposite to the first side 24. The platform 32 also includes a front bolt 38 fastened to the front of the platform 32 and a rear bolt 38 fastened to the rear of the platform 32. The bolts 38 are paired with the magnets 34 and positioned on the side of the magnets 34 opposite the corresponding brackets 36. The front bolt 38, front magnet 34, and front bracket 36 are generally aligned with each other in the side-to-side direction and the rear bolt 38, rear magnet 34, and rear bracket 36 are also generally aligned with each other in the side-to-side direction.

The ball support assembly 18 is releasably coupled to the platform 32. The ball support assembly 18 includes front and rear rod assemblies 40. The rod assemblies 40 are aligned with each other in the side-to-side direction, but are spaced apart from each other in the front-to-back direction to create spacing configured to cradle and support a ball (such as a football or soccer ball) from underneath the ball. Each rod assembly 40 includes a rod 42 having first and second ends. The first end is connected to one end of a plate 44 having a hole at the opposite end. The second, opposite end of the rod 42 is formed to have a concave shape to cradle the curved surface of the ball and inhibit the ball from rotating out of the concave shape and off of the rod 42. The curved surfaces of the rods 42 support the ball from underneath the ball, and no support or contact is provided to or made with the top half of the ball. The rods 42 pass under the vertical centerline of the ball from one side of the ball and contact the ball at and about the vertical centerline of the ball. Each rod assembly 40 is movably connected to the platform 32 by inserting one of the bolts 38 through the hole of the plate 44, positioning the plate 44 against the magnet 34, and extending the straight portion of the rod 42 (between the first and second ends) into the notch of the plate 44. This position of the rod assembly 40 defines a support position.

In use, a person will place the rod assemblies 40 in the support positions and then position a ball into the cradle defined by the rod assemblies 40 of the ball support assembly 18 thereby positioning the ball in a desired punting position. Depending upon the height of the person, that person may need to adjust the height of the platform 32 by adjusting the vertical position of the upper upright 30. With the ball in the cradle, the center of gravity of the training device 10 and ball is positioned on the first side of the training device 10 such that the training device 10 and ball do not tip toward the second side 26.

Once the ball is properly positioned, the person moves to the front of the training device an appropriate number of steps to allow for a proper approach to the ball for punting. After striking the ball, the person's follow through will cause the leg of the person to contact the rods 42 of the rod assemblies 40. As shown in FIG. 2, this will cause the rod assemblies 40 to pivot upwards and away from the person breaking contact between the magnet 34 and the plate 44 releasing the rod 42 from the support position and also allowing the rod assembly 40 to pivot away from the person about the axis defined by the bolt 38. FIG. 2 illustrates positions of the rod assemblies 40 after the ball has been kicked and the rod assemblies 40 come to rest. To minimize any discomfort in striking the rods 42, the person can wear protective gear such as a shin guard or the rod 42 can be covered with a soft, resilient material such as a neoprene sleeve or polymer tubing 58. To reset the ball support assembly 18, the rod assemblies 40 are placed back into the support positions.

In other constructions of the ball support assembly 18, the bolts 38 can be replaced with flexible tethers that connect the plates 44 to the platform 32. Similar to the previous construction, the tethers allow the rod assemblies 40 to release from the support positions and move freely away from the person's leg as they follow through their punting motion while still keeping the rod assemblies 40 attached to the platform 32 such that they can be easily returned to the support positions for a subsequent punt.

Figure 4:
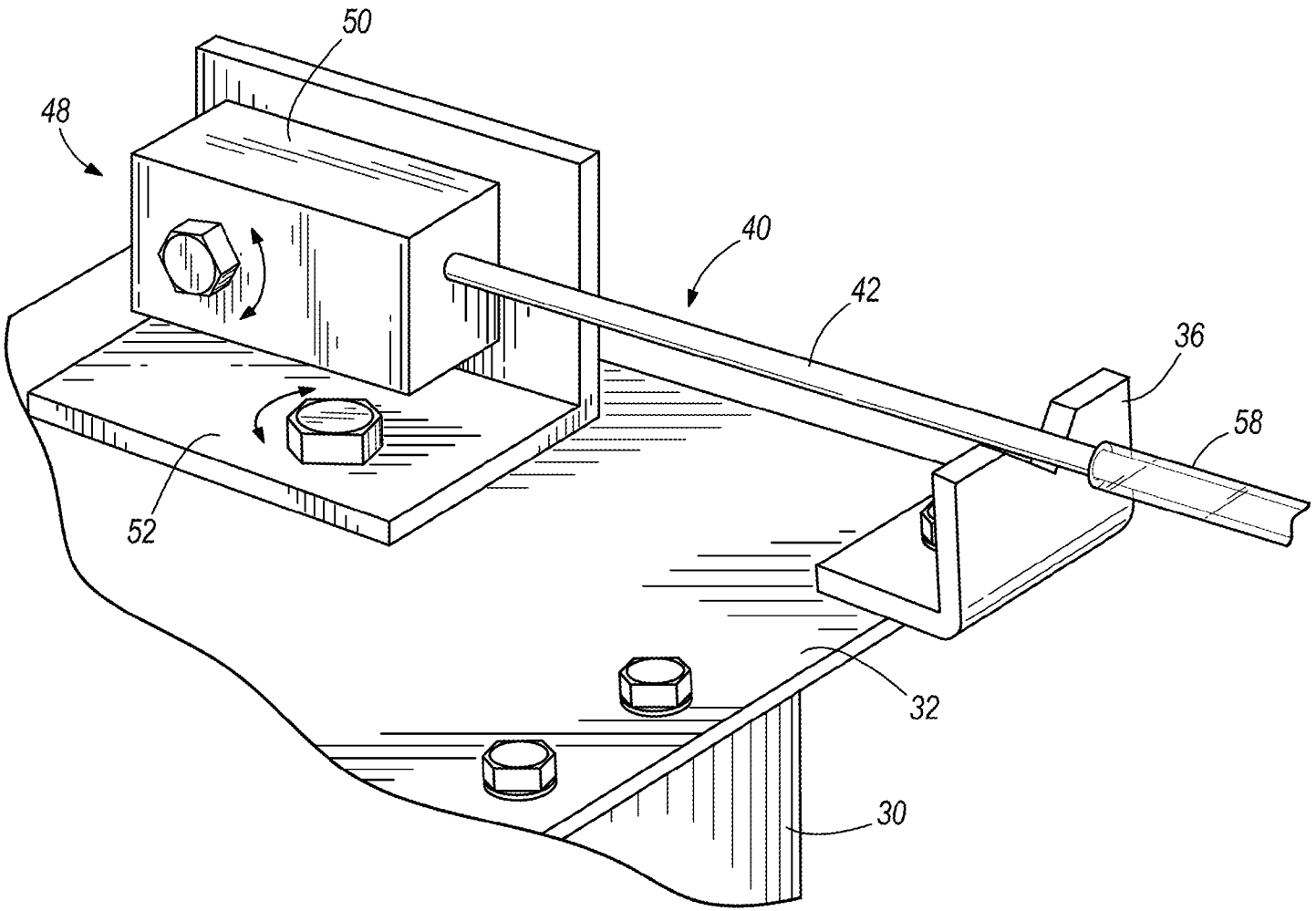
FIG. 4 is an enlarged perspective view of a portion of a rod assembly of another construction of a training device.

Another construction of the training device 10 is shown in FIG. 4 (although only a single rod assembly 40 is illustrated, the training device 10 of FIG. 4 would include two rod assemblies 40 similar to the constructions previously described). This construction replaces the bolts 38 and magnets 34 of the construction of FIGS. 1-3 with pivoting and rotating assemblies 48. With reference to FIG. 4, the pivoting and rotating assembly 48 includes a first member, or block 50, that is connected to the first end of the rod 42. The block 50 is coupled to a bracket 52 to allow for upward and downward pivoting motion (as shown by the arrow in FIG. 4) relative to the bracket 52. The bracket 52 is coupled to the platform 32 to allow for forward and backward rotating motion (as shown by the arrow in FIG. 4) relative to the platform 32. Therefore, in combination the pivoting and rotating assembly 48 allows for pivoting and rotating motion of the rods 42 relative to the platform 32. By this arrangement, the rods 42 are allowed to move in a random direction, but within a contained space, away from the punter.

Figure 5:
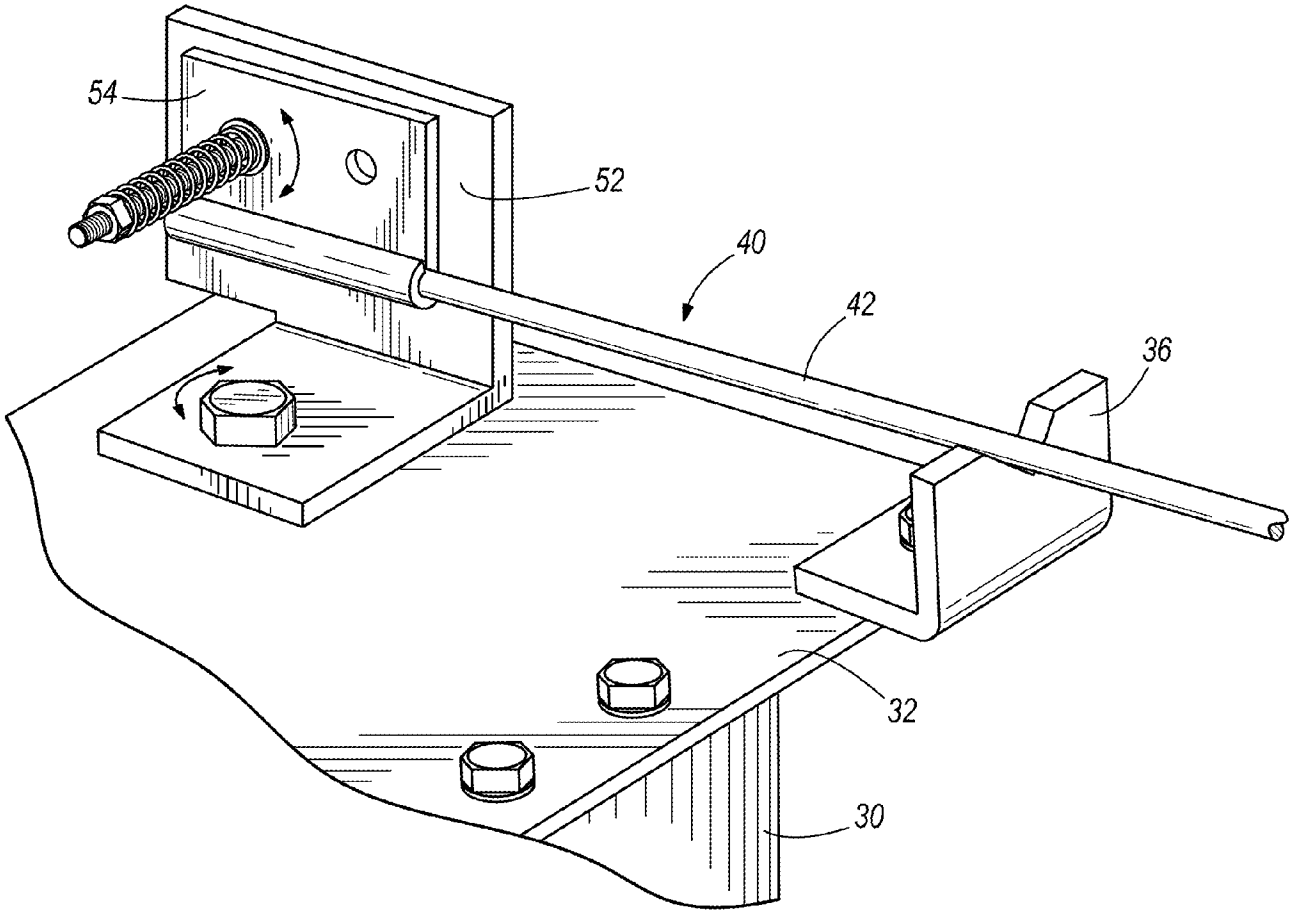
FIG. 5 is an enlarged perspective view of a portion of a rod assembly of another construction of a training device.

In other constructions, as shown in FIG. 5, the first member of the pivoting and rotating assembly 48 can be a second bracket 54 instead of a block 50. In addition, the second bracket 54 can be coupled to the first bracket 52 by a bolt, a coil spring over the bolt, and nut threaded to the bolt such that when the nut is tightened onto the bolt, the spring is compressed thereby providing an adjustable compressive force against the first and second brackets 52, 54 to create a corresponding friction therebetween. This acts as an adjustable braking mechanism to diminish or eliminate spring back by the rods after the ball has been punted.

Similar to the method of operation described above, a person first properly positions the ball in the cradle and then moves to the front of the training device 10 an appropriate number of steps to allow for a proper approach to the ball for punting. After striking the ball, the person's follow through will cause the leg of the person to contact the rods 42 of the rod assemblies 40. This will cause the rod assemblies 40 to pivot upwards and rotate away from the person (through the pivoting and rotating assembly 48) thereby releasing the rod 42 from the support position. After the ball has been kicked, the rod assemblies 40 come to rest. To reset the ball support assembly 18, the rod assemblies 40 are placed back into the support positions by rotating and pivoting the rod assemblies 40 in the reverse direction (through the pivoting and rotating assemblies 48) and placing the rods 42 back into the notches of the brackets 36.

Figure 6:
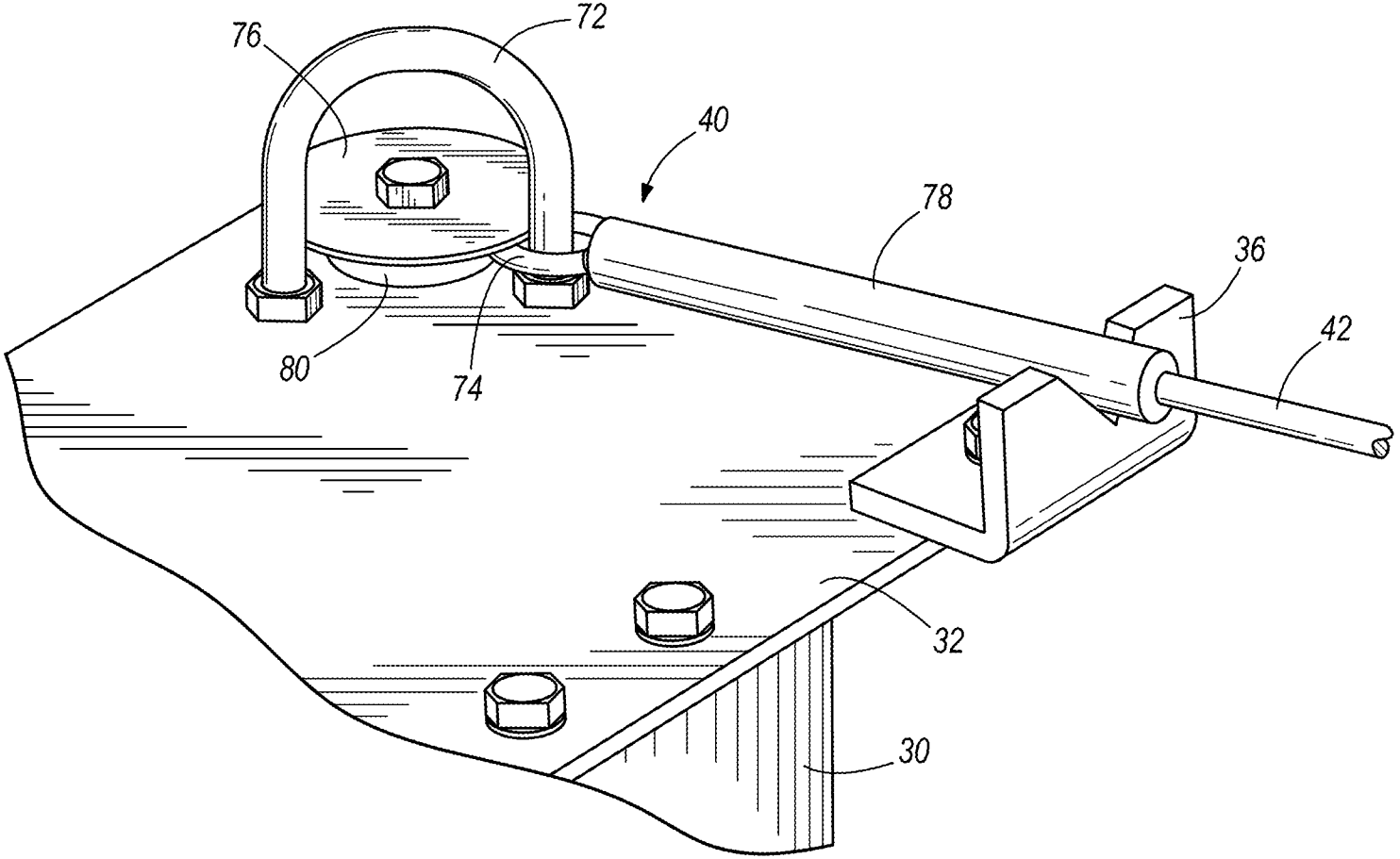
FIG. 6 is an enlarged perspective view of a portion of rod assembly of another construction of a training device.

Another construction of the training device 10 is shown in FIG. 6 (although only a single rod assembly 40 is illustrated, the training device 10 of FIG. 4 would include two rod assemblies 40 similar to the constructions previously described). This construction replaces the bolts 38 and magnets 34 of the construction of FIGS. 1-3 with U-bolts 72, eye-bolts 74, and hold-down washers 76. The first end of the rod 42 is connected to one end of a metal shaft 78 that in turn connects at its other end to the shaft end of the eye-bolt 74 having an eyelet. Each rod assembly 40 is movably connected to the platform 32 by inserting one of the U-bolts 72 through the eyelet of the eye-bolt 74. The platform assembly 16 also includes the hold down washers 76 positioned behind the U-bolts 72 (opposite to the rods 42). The hold down washers 76 are each spaced above the platform 32 by a compressible spacer 80 that is sandwiched between the platform 32 and the washer 76 by a bolt that connects the washer 76 and spacer 80 to the platform 32. The distal ends of the eyebolts 74 are positioned at least partially under the washers 76 and the metal shafts 78 are positioned into the notches of the brackets 36. This position of the rod assembly defines a support position.

In use, a person will place the rod assemblies 40 in the support positions and then position a ball into the cradle defined by the rod assemblies 40 of the ball support assembly 18 thereby positioning the ball in a desired punting position. After striking the ball, the person's follow through will cause the leg of the person to contact the rods 42 of the rod assemblies 40. This will cause the rod assemblies 40 to pivot upwards and laterally sideways away from the person breaking contact between the eyebolts 74 and the washers 76 releasing the rods 42 from the support positions and also allowing the rod assemblies 40 to pivot away from the person about the U-shaped axis defined by the U-bolts 72. After the ball has been kicked, the rod assemblies 40 come to rest. To reset the ball support assembly 18, the rod assemblies 40 are placed back into the support positions.

Figure 7:
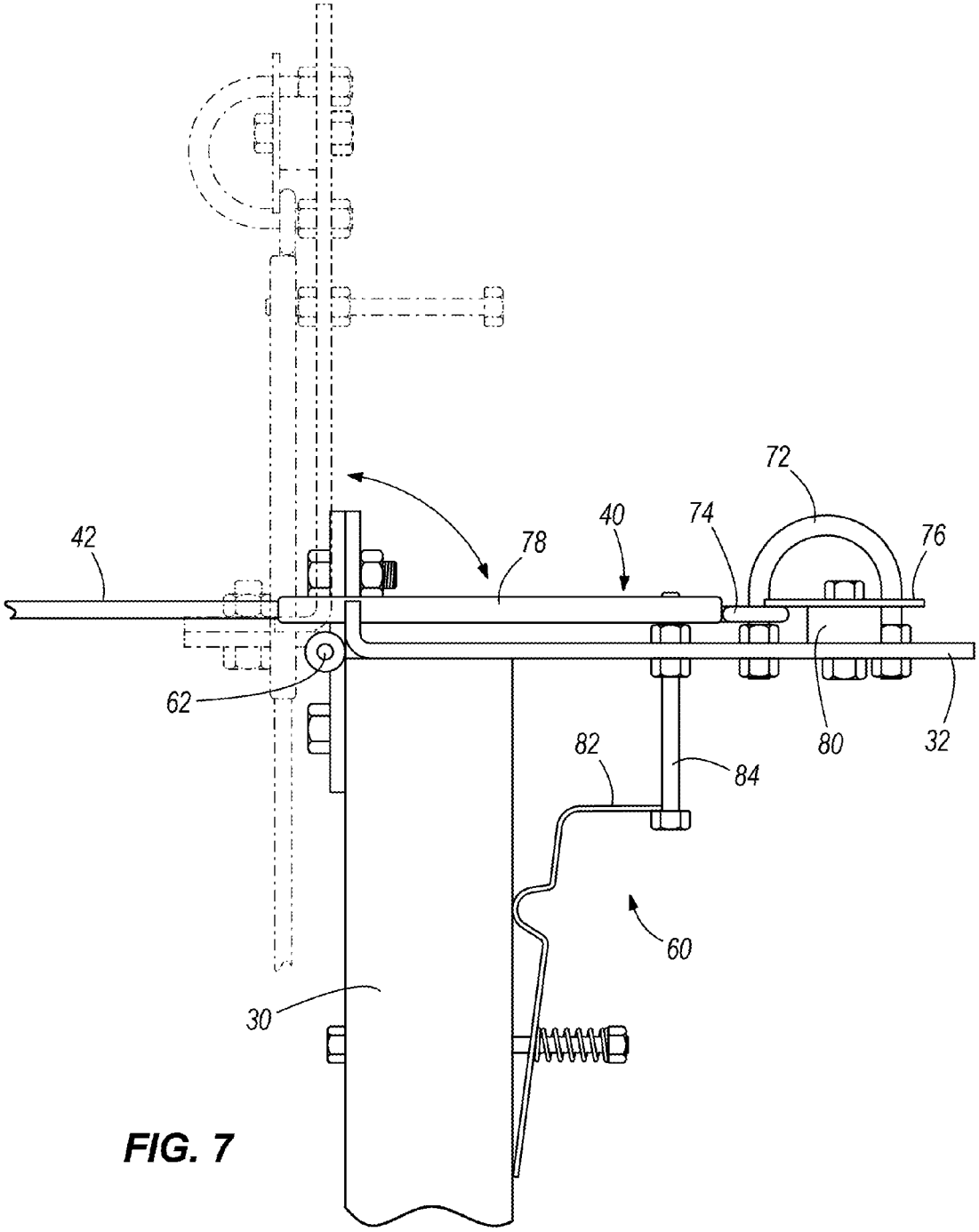
FIG. 7 is a front view of another construction of a training device having a breakaway device adapted to release a pivoting platform.

As best shown in FIG. 7, the training device 10 can include a break-away mechanism 60 that allows the platform 32 to pivot such that the ball support assembly 18 pivots downwardly away from the support position in the event that a sufficient downward force is applied to the rod assemblies 40. The training device 10 includes a hinge 62 positioned toward the second side 26 between the platform 32 and the upper upright 30. The break-away mechanism 60 is positioned on the underside of the platform 32 and includes a spring biased, pivoting latch plate 82 held in place by at least one fastener connected to the upper upright 30. The fastener supports a spring that is held in compression such that is applies a force on the pivoting latch plate 82. The break-away mechanism 60 also includes a bolt 84 connected to the underside of the platform 32. The bolt head is positioned under and retained by the pivoting latch plate 82 when the platform 32 is horizontal or in a support position. When a sufficient downward force is applied to the rods 42, the bolt 84 will pivot the latch plate 82 against the bias of the spring thereby releasing the bolt 84 and platform assembly 16 allowing it to pivot about the hinge 62 toward the second side 26. If the platform 32 moves to the break-away position (shown in phantom lines), the platform 32 can be rotated back about the hinge 62 until the bolt head is again positioned below the pivoting latch plate 82.

Another construction of a break-away mechanism can utilize a magnet and plate arrangement to releasably couple the pivoting platform to the upper upright. This construction allows the platform to pivot toward the second side in the event that a sufficient downward force is applied to the rod assemblies to disengage the magnet and the plate.

Figure 8B:
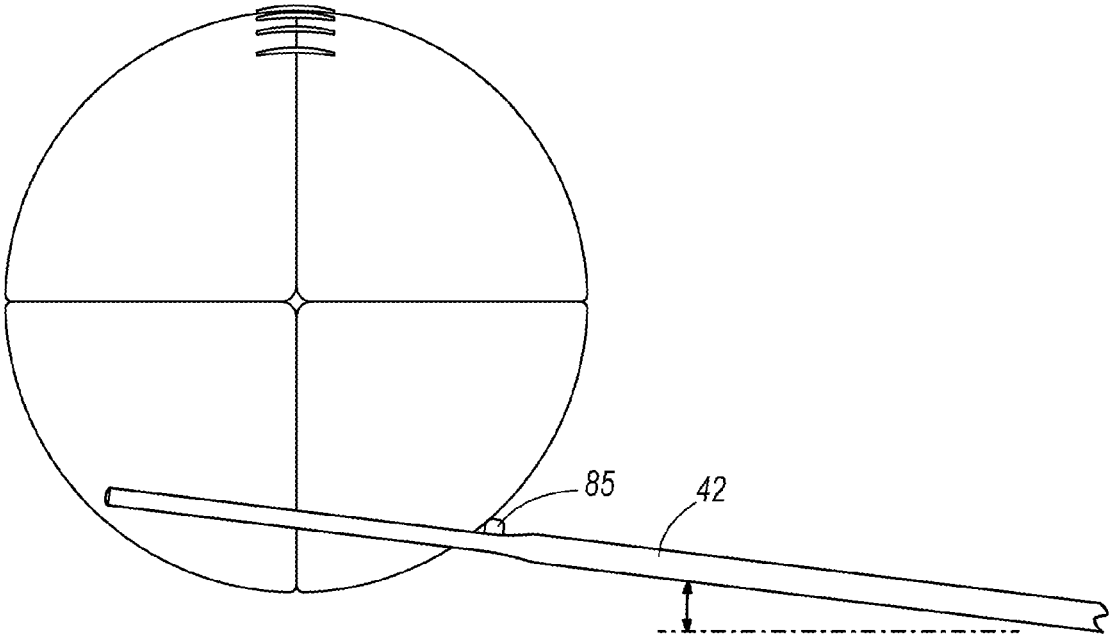
FIG. 8B is a front view of a portion of the training device of FIG. 8A.
Figure 8A:
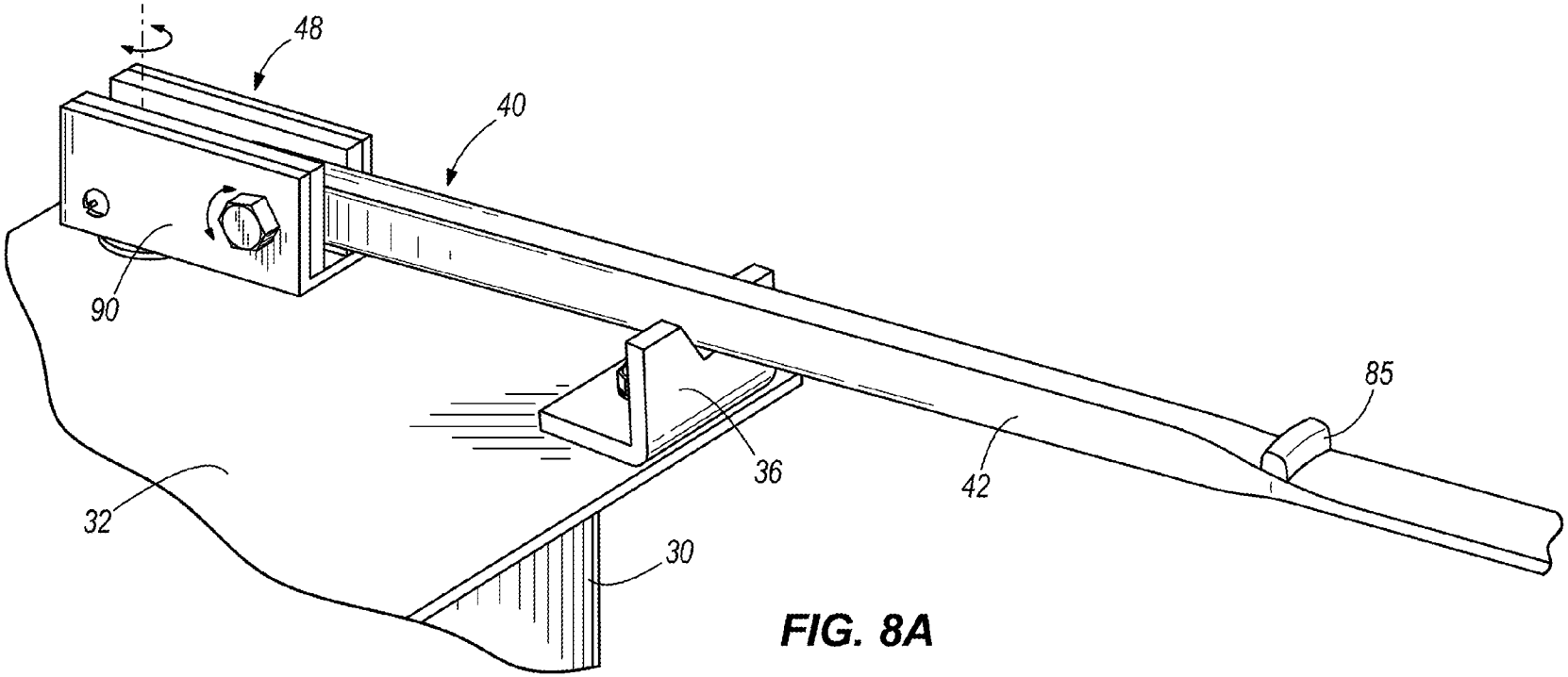
FIG. 8A is an enlarged perspective view of a portion of a rod assembly of another construction of a training device.

Another construction of the training device 10 is shown in FIGS. 8A-8B (although only a single rod assembly 40 is illustrated, the training device 10 of FIGS. 8A-8B would include two rod assemblies 40 similar to the constructions previously described). The rod assembly 40 includes a rod 42 that is made from a polymeric material such as polyethylene. The rod 42 includes a generally rectangular cross-section throughout its length. However, the orientation of the rectangular cross-section is vertical near the first end and horizontal near the second end. In other constructions, the orientation of the rectangular cross-section of the rods 42 can be canted from horizontal such that the second ends follow the contour of the ball. The second end includes a raised stop 85 to prevent the ball from rolling toward the first end of the rod 42 when the football is supported on the rods 42. As shown in FIG. 8B, the rods 42 are angled slightly upward such that the second end and the stop 85 together define the cradle for supporting the football.

The first end of the rod is pivotably attached to a bracket 90 by a fastener to allow the rod 42 to pivot up and down relative to the bracket 90 (as shown by the arrow in FIG. 8A). The bracket 90 is rotatably attached to the platform 32 by another fastener to allow the rod 42 and the bracket 90 to rotate in the forward and backward directions relative to the platform 32 (as shown by the arrow in FIG. 8A). Therefore, in combination the pivoting and rotating assembly 48 allows for pivoting and rotating motion of the rods 42 relative to the platform 32. By this arrangement, the rods 42 are allowed to move in a random direction, but within a contained space, away from the punter.

Similar to the method of operation described above, a person first properly positions the ball in the cradle and then moves to the front of the training device 10 an appropriate number of steps to allow for a proper approach to the ball for punting. After striking the ball, the person's follow through will cause the leg of the person to contact the rods 42 of the rod assemblies 40. This will cause the rod assemblies 40 to pivot upwards and rotate away from the person (through the pivoting and rotating assembly 48) thereby releasing the rod 42 from the support position. After the ball has been kicked, the rod assemblies 40 come to rest. To reset the ball support assembly 18, the rod assemblies 40 are placed back into the support positions by rotating and pivoting the rod assemblies 40 in the reverse direction (through the pivoting and rotating assemblies 48) and placing the rods 42 back into the notches of the brackets 36.

Figure 9A:
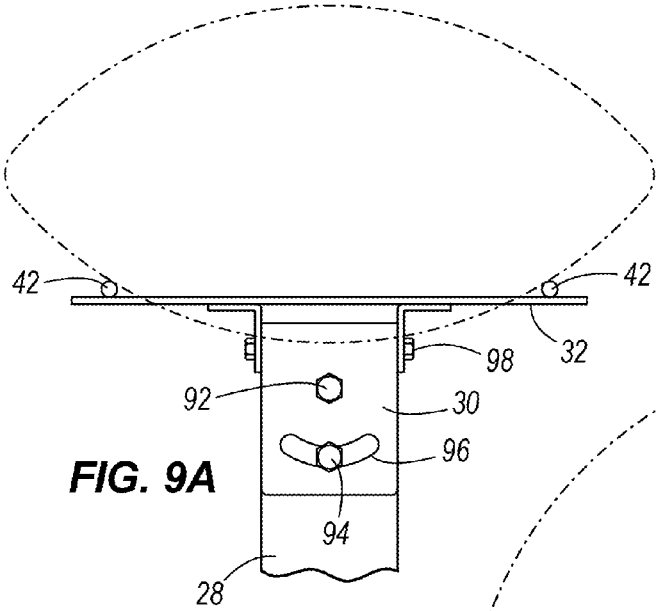
FIG. 9A is a side view of another construction of a training device.
Figure 9B:
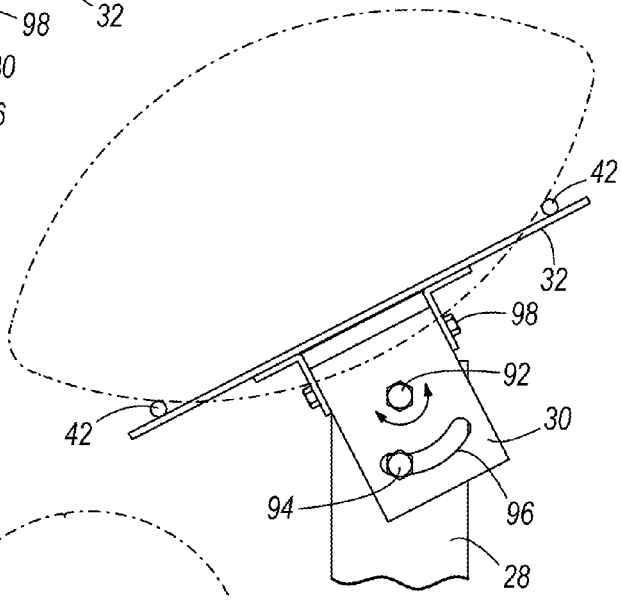
FIG. 9B is a side view similar to FIG. 9A, illustrating a platform pivoted downwardly to the front.

FIGS. 9A-9B illustrate one construction for mounting the platform 32 to the upper upright 30 to allow the platform 32 to pivot in the front-to-back direction allowing adjustment of the angle of the football toward and away from the kicker. As shown in FIGS. 9A and 9B, a top bolt 92 passes through aligned holes in the bottom and upper uprights 28, 30. The top bolt 92 holds the bottom and upper uprights 28, 30 together while still allowing the upper upright 30 (and platform 32) to rotate relative to the bottom upright 28 about an axis defined by the top bolt 92. A bottom bolt 94 passes through a hole in the bottom upright 28 and a upwardly oriented curved slot 96 in the upper upright 30. The bottom bolt 94 holds the bottom and upper uprights 28, 30 together when tightened and allows the upper upright 30 (and platform 32) to rotate relative to the bottom upright 28 about the axis defined by the top bolt 92 when the bottom bolt 94 is loosened. When the upper upright 30 is rotated, the position of the bottom bolt 94 within the slot 96 moves and the terminal ends of the slot 96 define the extent of possible adjustment.

To adjust the front-to-back angle of the football prior to kicking, the bottom bolt 94 is loosened, and the upper upright 30 and the platform 32 are moved into the desired position. Once in the desired position, the bottom bolt 94 is tightened to secure the upper upright 30 and the platform 32 in the desired position for kicking. This friction allows the stability to hold the ball in the proper punting position, and still have a break-away mechanism that allows the platform 32 to pivot such that the rod 42 pivots downwardly away from the support position in the event that a sufficient downward force is applied to the rod 42. This construction eliminates a latch or a magnet as a means of keeping the platform in a punting position.

Figure 9C:
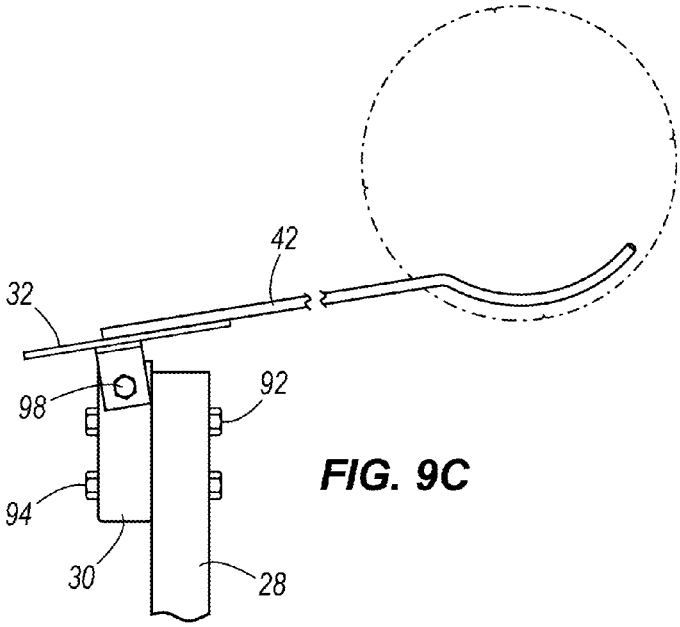
FIG. 9C is a front view of the training device of FIG. 9A, illustrating the platform pivoted downwardly to the side.

In addition, FIG. 9C illustrates one construction for mounting the upper upright 30 to the bottom upright 28 to allow the platform 32 to pivot in the side-to-side direction allowing adjustment of the angle of the football in a side-to-side direction. The platform 32 is pivotably attached to the upper upright 30 by a fastener 98 that is tightened to allow movement between the upper upright 30 and the platform 32 when a sufficient force overcomes the friction of the fastener 98. When no such force is applied, the fastener 98 holds the relative position of the platform 32 and the upper upright 30.

To adjust the side-to-side angle of the football prior to kicking, the athlete will grab the platform 32 with one hand and grab the upper upright 30 with the other hand and pivot the platform 32 relative to the upper upright 30 until the desired side-to-side position is obtained. When in the desired position, the athlete merely lets go of the platform 32 and the upper upright 30 and the friction caused by the fastener 98 will hold the relative position.

The training device 10 can be made using materials such as wood and steel, however, the invention should not be limited to such. Instead, the training device 10 could be constructed from other materials such as plastics or other metals. In addition, although the base assembly 12, the upright assembly 14, the platform assembly 16, and the ball support assembly 18 are generally constructed as separate assemblies from multiple components, the assemblies 12, 14, 16, 18 could be integrated together such that a single part could form an entire assembly or could form portions of one or more assembly. For example, although the design may include a base assembly 12 and an upright assembly 14, these two assemblies 12, 14 could be made from a single molded or welded structure.

Although the illustrated constructions of the ball support assemblies 18 include two rod assemblies 40 for supporting the ball, other constructions of the ball support assembly can include a single rod assembly 40 (e.g., located centrally on the platform) or more than two rod assemblies 40. The single rod assembly 40 could include supporting structure on the end of the rod 42 that could independently cradle the ball and support the ball from beneath the ball. For example, the supporting structure could be a molded truncated spherical shape or other concave shape that mirrors the shape of the ball. In other constructions the single rod assembly 40 could have a forked end that includes curved portions that are used to cradle the ball. In yet other embodiments, the forked end could support a net or molded structure that could support the ball from beneath the ball.

Figure 10:
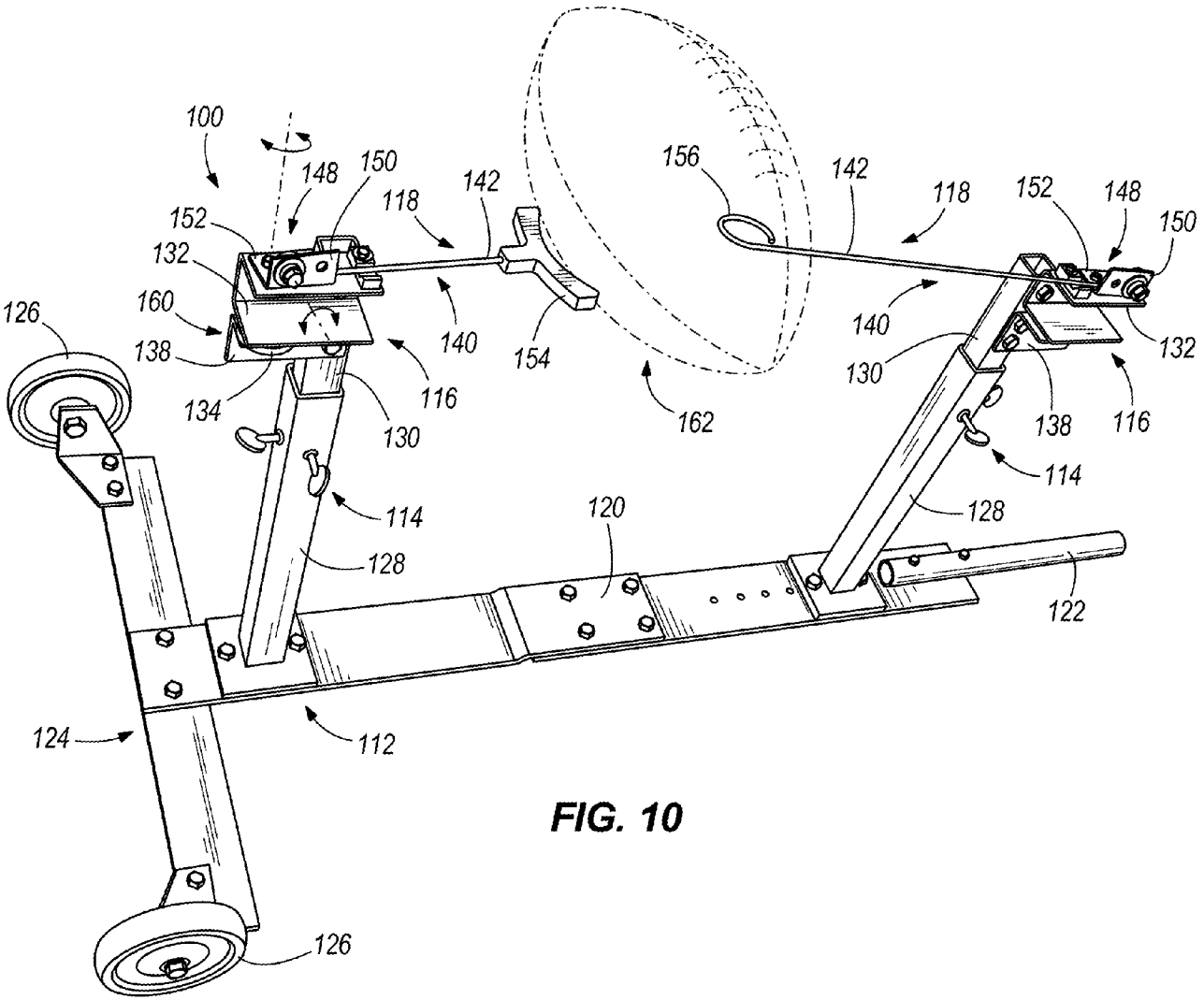
FIG. 10 a front perspective view of another construction of a training device supporting a football.
Figure 11:
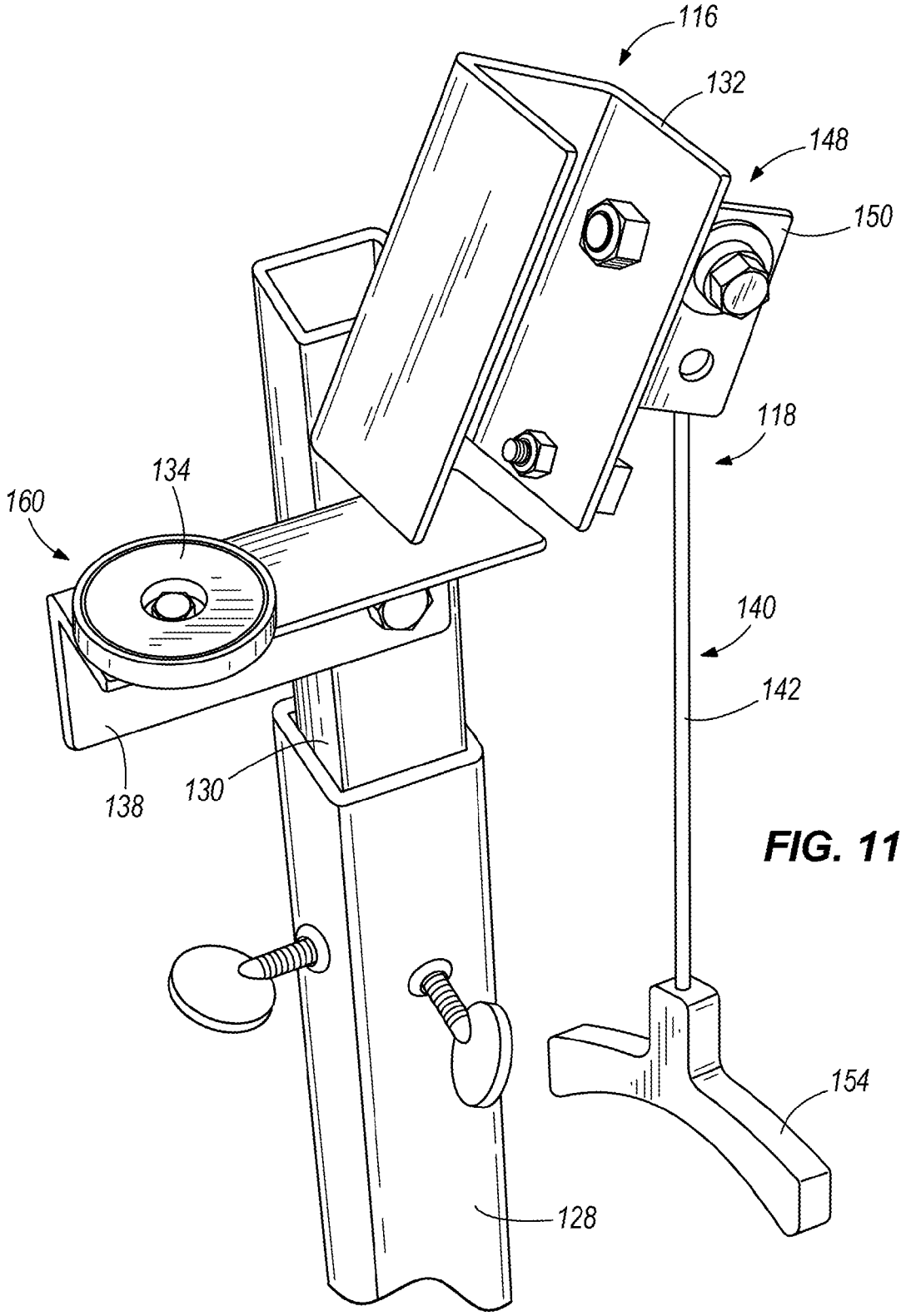
FIG. 11 is an enlarged perspective view of the ball support assembly of the training device of FIG. 10.

The constructions of the training device described above support the ball to be kicked from one side of the ball. FIGS. 10 and 11 illustrate a punting training device 100 according to one construction of the invention, and the training device 100 is used to support a ball from both sides in an appropriate, stationary position for a person to swing their leg and punt the ball away from the training device 100. As shown in FIG. 10, the training device 100 includes a base assembly 112, adjustable upright assemblies 114, platform assemblies 116, and a ball support assembly 118. The base assembly 112 is generally T-shaped and includes a center member 120 having two opposed ends. A handle 122 is attached to the central member 120 at one end and a wheel assembly 124 is attached to the central member 120 at the other end. In the position shown in FIG. 10, the training device 100 lies flat against the ground or support surface such that wheels 126 of the wheel assembly 124 are raised above the ground. When the training device is transported, the athlete can grip the handle 122 and pivot the training device 100 upward such that it pivots at its opposite end causing the wheels 126 to contact the surface. Once the wheels 126 make contact with the ground, the training device 100 can be rolled along the ground for ease of transport.

The upright assemblies 114 are connected to the base 112 and extend vertically upward. The upright assemblies 114 are spaced apart from each other along the length of the base 112. Each upright assembly 114 includes a bottom upright 128 fastened to the center member 120 and an upper upright 130 that is adjustably fastened to the bottom upright 128. In the illustrated embodiment, the upper upright 130 is telescopingly received into the bottom upright 128. At least one fastener is used to secure the upper upright 130 into position relative to the bottom upright 128. A platform assembly 116 is connected to the top of each upper upright 130. In other constructions, instead of winged fasteners, a tubular locking mechanism or a torsion locking device may be used when utilizing two cylindrical telescoping tubes for the upright assembly.

The platform assembly 116 includes a platform 132 that is pivotably connected to the upper upright 130 by a fastener. The platform assembly 116 also includes a bracket 138 located below the platform 132 and a magnet 134 connected to the topside of the bracket 138 between the bracket 138 and the bottom side of the platform 132. When in the support position, the platform 132 is pivoted about the axis of its fastener to a position where the bottom surface of the platform 132 contacts the magnet 134. In the support position, the platform 132 is oriented substantially horizontally. The magnet 134, bracket 138, and the pivoting platform 132 together define a break-away mechanism 160. In other constructions, the magnet 134 can be connected to the bottom of the platform 132 instead of the top of the bracket 138. Such a construction would be equally effective to define a break-away mechanism.

The training device 100 includes a ball support assembly 118 that is releasably coupled to the platforms 132. The ball support assembly 18 includes left and right rod assemblies 140. The rod assemblies 140 are adjustably aligned with each other in the front-to-back direction, but are spaced apart from each other in the side-to-side direction to create spacing configured to cradle and support a ball from underneath, and only underneath, the ball and from both sides of the ball. The rods 142 do not pass under the vertical centerline of the ball, but contact the bottom half of the ball at both sides of the ball away from the vertical centerline of the ball.

Each rod assembly 140 is similar to the constructions illustrated in FIGS. 4 and 5 in that each includes a pivoting and rotating assembly 148 having a first member, or bracket 150, that is connected to the first end of the rod 142. The bracket 150 is coupled to a bracket 152 to allow for upward and downward pivoting motion (as shown by the arrow in FIG. 10) relative to the bracket 152. The bracket 152 is coupled to the platform 132 to allow for forward and backward rotating motion (as shown by the arrow in FIG. 10) relative to the platform 32. Therefore, in combination the pivoting and rotating assembly 148 allows for pivoting and rotating motion of the rods 142 relative to the platform 132. By this arrangement, the rods 142 are allowed to move in a random direction, but within a contained space, away from the punter.

One difference between the rods 42 previously described and the rods 142 illustrated in FIG. 10 is that the rods 142 do not include the curved portions, but instead include different end portions for contacting the football. As shown in FIG. 10, the left rod includes a forked end 154 that is made from molded plastic or rubber. The forked end 154 creates two points of contact for supporting the underside of the ball on one side of the ball. The right rod includes a bent circular tip 156 that is formed integrally with the rod 142 itself. The tip 156 creates a single point of contact for supporting the underside of the ball on the opposite side of the ball. The three points of contact in total together create a cradle for the ball that can support the ball from underneath in a multitude of ball orientations. In other constructions, forked ends could be used on both rods 142 such that four points of contact in total can be achieved.

In use, a person will place the rod assemblies 140 in the support positions and then position a ball into the cradle defined by the rod assemblies 140 of the ball support assembly 118 thereby positioning the ball in a desired punting position. Depending upon the height of the person, that person may need to adjust the height of the platform 132 by adjusting the vertical position of the upper upright 130.

Once the ball is properly positioned, the person moves to the front of the training device 100 an appropriate number of steps to allow for a proper approach to the ball for punting. After striking the ball, the person's follow through may cause the leg of the person to contact the rods 142 of the rod assemblies 140. This will cause the rod assemblies 140 to pivot upwards and away from the person. Also, depending on the skill of the athlete, the athlete may kick the ball without making contact with the rod assemblies 140 at all. To reset the ball support assembly 118, the rod assemblies 140 are placed back into the support positions, and the ball is returned to the cradle defined by the forked end 154 the and tip 156.

The training device 100 uses support rods 142 from two sides thereby defining a space 162 between the rods 142 as shown in FIG. 10. When the support rods 142 are placed in the ball support position, the space 162 is wide enough for the punters foot to pass through while practicing his approach and punt action without a football and without moving the ball support rods 142. When practicing in this manner the punter knows immediately if he is successful, or if he has hit the ends of the support rods 142 with his foot. With the football in place the punter can also determine the control of his punt action if the support rods 142 move during the punt.

In this way, the space 162 between the left and right rod ends 154, 156 in FIG. 10 can be used to practice punting without a ball placed on the support rods 142. The punter can practice proper approach before the punt and swing concentrating on the alignment and accuracy of the punting foot as it passes through the space 162 so as not to hit the rods 142. The support rods 142 can be manually rotated forward or backward on the platform 132 to widen the space 162 between the rods 142 for a wider foot. The punter could also widen the space between the rod ends 154, 156 at the start of his practice and reduce space as he gains control of his foot swing.

In addition to rotating the support rods 142 forwards and backwards to adjust the space 162 between the rod ends 154, 156, other constructions may also include laterally adjustable upright assemblies 114. In one example, the bottom upright 128 could be adjustably mounted to the center member 120 by providing laterally-oriented slots in the bottom flange that receive fasteners to couple the bottom upright to the center member 120. In this manner, the fasteners could be loosed to allow lateral adjustment of the upright assemblies such that the space 162 between the rod ends 154, 156 could be widened or narrowed. In yet another example, the upright assemblies 114 could pivot laterally relative to the center member 120 to adjust the distance between the rod ends 154, 156. One way to accomplish this would be to provide an adjustment screw inside of both of the fasteners used to couple the flange of each bottom upright 128. In this construction, the adjustment screw would be threaded through a hole in the flange such that the flange and the lower upright 128 would pivot outward when the adjustment screw is turned in one direction and pivot back toward the vertical position when the adjustment screw is turned in the opposite direction. During adjustment, the two fasteners of the flange would be loosened such that the flange and bottom upright 128 are allowed to pivot about the outer edge of the flange. The fasteners would again be tightened after the desired position is obtained.

Figure 12:
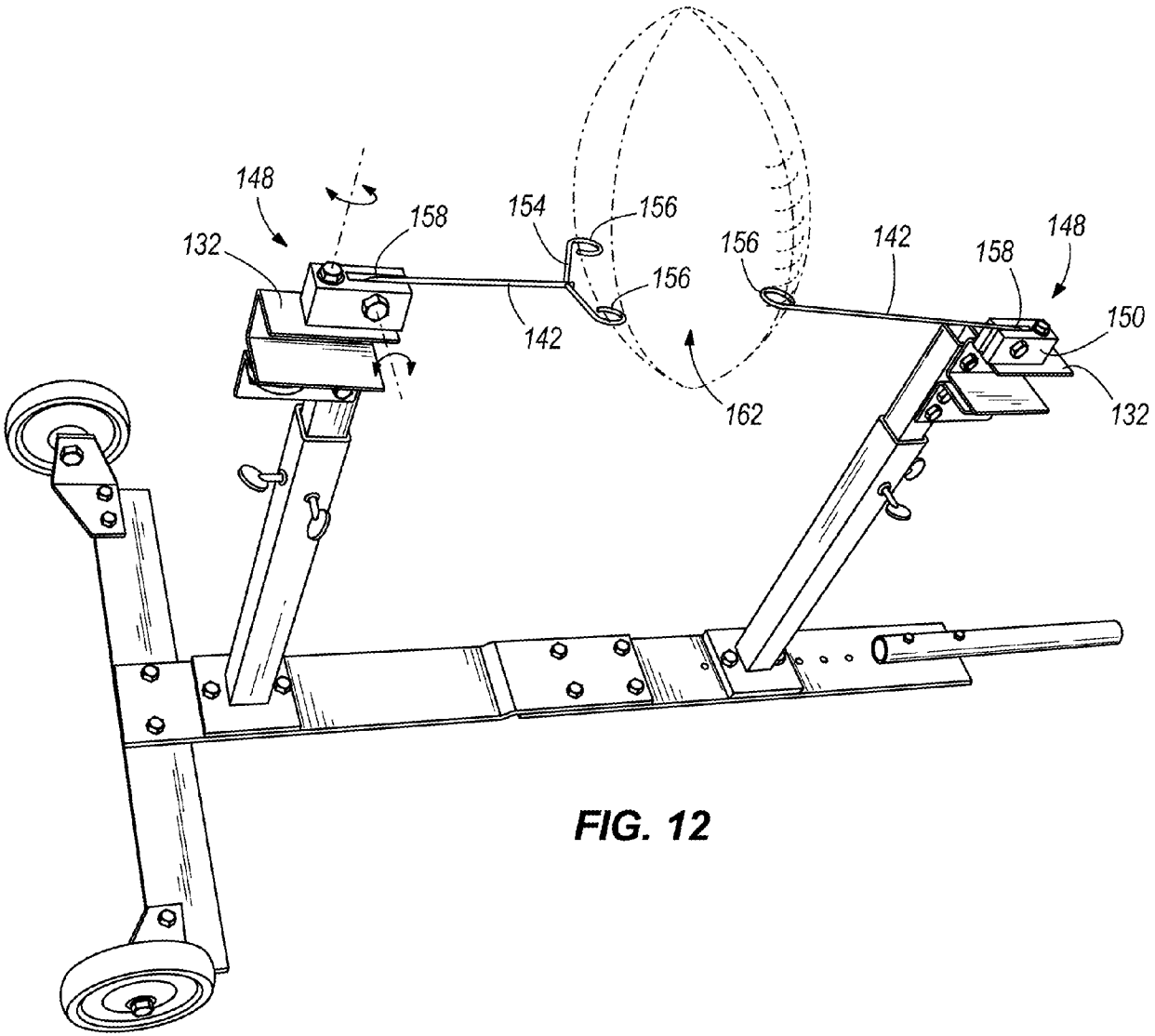
FIG. 12 is a front perspective view of another construction of a training device supporting a football.

FIG. 12 illustrates another construction of the invention that again supports the ball from underneath on both sides of the ball. FIG. 12 differs from FIG. 10 in that the construction of FIG. 12 includes another construction of the rotating and pivoting assemblies 148. In the construction illustrated in FIG. 12, the rotating and pivoting assemblies 148 include a first member, or block 150 that is pivotably connected to a hooked end 158 of the rod 142 with a first fastener to allow for upward and downward pivoting motion (as shown by the arrow in FIG. 12) relative to the block 150. The block 150 is rotatably connected to the platform 132 with a second fastener to allow for forward and backward rotating motion (as shown by the arrow in FIG. 12) relative to the platform 132. Therefore, in combination the pivoting and rotating assembly 148 allows for pivoting and rotating motion of the rods 142 relative to the platform 132. By this arrangement, the rods 142 are allowed to move in a random direction after the ball is punted, but within a contained space, away from the punter. The first and second fasteners can be tightened to increase the resistance to the pivoting and rotating motion of the rods 142 to thereby create a braking effect. The block can be made from a polymer such as a 75D durometer polyurethane.

Additionally, the construction of FIG. 12 replaces the forked end 154 of the FIG. 10 construction. As shown in FIG. 12, the forked end 154 is formed by bending metal wire to include two leg portions that are bent into two circular tips 156. The intermediate rod portion between the tips 156 is bent slightly and welded to the end of the rod 142. Similar to the forked end 154 of the FIG. 10 construction, the forked end 154 of the FIG. 12 construction creates two points of contact with the ball.

The construction shown in FIG. 10 is shown supporting the football in the horizontal orientation and the construction of FIG. 12 is shown supporting the ball in a vertical orientation. However, it should be noted that any of the illustrated constructions of the training device can support the ball in any orientation. In addition, each of the illustrated constructions contact only the bottom half of the ball regardless of whether the ball is supported from a single side or from two opposed sides.

Other aspects of the invention will become apparent by consideration of the detailed description and accompanying drawings.

The invention claimed is:

1. A training device for punting, the training device comprising:

a ball;

a base assembly disposed on the support surface and defining a notch;

a ball support assembly coupled to the base assembly and configured to contact the bottom of the ball from at least one side of the ball such that the ball is supported above and spaced from the support surface for punting when the ball support assembly is in a support position, wherein a portion of the ball support assembly is receivable in the notch to position the ball support assembly in the support position, and wherein the ball support assembly is movably coupled to the base assembly such that the ball support assembly moves relative to the base assembly in a first direction that is up and away from the support position and out of the notch in response to the ball being punted, and wherein the portion of the ball support assembly is movable back into the notch by rotating or pivoting the ball support assembly in a second direction that is opposite the first direction.

2. The training device as claimed in claim 1, wherein the ball support assembly extends from the base assembly in a single direction in the support position such that the ball is supported from only one side.

3. The training device as claimed in claim 1, wherein the ball support assembly extends from the base assembly in two directions in the support position such that the ball is supported from two sides.

4. The training device as claimed in claim 1, wherein the ball support assembly includes two rod assemblies, each rod assembly including a first end coupled to the base assembly and a second end adapted to contact the ball in the support position.

5. The training device as claimed in claim 4, wherein the rod assemblies extend from the base assembly in substantially the same direction in the support position such that the ball is supported from only one side.

6. The training device as claimed in claim 4, wherein the rod assemblies extend from the base assembly in substantially opposite directions in the support position such that the ball is supported from two sides.

7. The training device as claimed in claim 1, further comprising a break away device coupled between the ball support assembly and the base assembly such that the ball support assembly supports the ball in the support position and moves relative to the base assembly down and out of the support position upon the introduction of a sufficient downward force on the ball support assembly.

8. The training device as claimed in claim 1, further comprising a break away device including a releasable couple between the ball support assembly and the base assembly such that the releasable couple couples the ball support assembly to the base assembly to hold the ball support assembly in the support position, the releasable couple decoupling the ball support assembly from the base assembly to allow the ball support assembly to pivot down about an axis relative to the base assembly and move the ball support assembly out of the support position upon the introduction of a sufficient downward force on the ball support assembly.

9. The training device as claimed in claim 8, wherein the releasable couple includes a spring loaded latch releasably coupled to the ball support assembly to hold the ball support assembly in the support position, and wherein a sufficient downward force on the ball support assembly moves the spring loaded latch allowing the ball support assembly to move relative to the base assembly down and out of the support position.

10. The training device as claimed in claim 8, wherein the releasable couple includes a magnet releasably coupled to the ball support assembly to hold the ball support assembly in the support position, and wherein a sufficient downward force on the ball support assembly moves the ball support assembly out of contact with and away from the magnet to move the ball support assembly relative to the base assembly down and out of the support position.

11. The training device as claimed in claim 8, wherein the ball support assembly extends from the base assembly in a single direction in the support position such that the ball is supported from only one side.

12. The training device as claimed in claim 8, wherein the ball support assembly extends from the base assembly in two directions in the support position such that the ball is supported from two sides.

13. The training device as claimed in claim 8, wherein the ball support assembly includes two rod assemblies, each rod assembly including a first end coupled to the base assembly and a second end adapted to contact the ball in the support position.

14. The training device as claimed in claim 13, wherein the rod assemblies extend from the base assembly in substantially the same direction in the support position such that the ball is supported from only one side.

15. The training device as claimed in claim 13, wherein the rod assemblies extend from the base assembly in substantially opposite directions in the support position such that the ball is supported from two sides.

16. The training device as claimed in claim 8, wherein the ball support assembly includes a cradle for contacting and supporting the ball entirely from underneath the ball.

17. The training device as claimed in claim 8, further comprising a platform pivotably coupled to the base assembly and fixedly coupled to the ball support assembly, wherein the releasable couple decouples the platform from the base assembly to allow the platform to pivot down about an axis relative to the base assembly and move the ball support assembly out of the support position upon the introduction of a sufficient downward force on the ball support assembly.

18. The training device for punting as claimed in claim 1, wherein the ball support assembly includes a cradle for contacting and supporting the ball.

19. The training device as claimed in claim 1, further comprising a bracket coupled to and extending upward from the platform base assembly, the bracket defining the notch.

20. The training device as claimed in claim 1, wherein the notch defines an upward opening to support an underside of the ball support assembly.

21. The training device as claimed in claim 1, wherein the ball support assembly is slidably insertable and removable from the notch.

22. The training device as claimed in claim 1, wherein the base assembly includes an adjustable upright assembly coupled to the ball support assembly and operable to adjust the height of the ball support assembly above the support surface.

* * * * *